US005810016A

United States Patent [19]

Okumoto

[11] Patent Number: 5,810,016

[45] Date of Patent: Sep. 22, 1998

[54] COMPRESSION MOLDING APPARATUS FOR A CUT TOBACCO LAYER IN A CIGARETTE MANUFACTURING MACHINE

[75] Inventor: Yutaka Okumoto, Tokyo, Japan

[73] Assignee: Japan Tobacco Inc., Tokyo, Japan

[21] Appl. No.: 845,375

[22] Filed: Apr. 24, 1997

[30] Foreign Application Priority Data

Apr. 26, 1996 [JP] Japan ..... 8-107532

[51] Int. Cl.[6] ..... A24C 5/00

[52] U.S. Cl. ..... 131/84.1; 131/84.2; 131/84.3; 131/84.4

[58] Field of Search ..... 131/84.1, 84.2, 131/84.4, 84.3

[56] References Cited

U.S. PATENT DOCUMENTS 4,917,118 4/1990 Mawgiarotti ..... 131/84.1

5,494,053 2/1996 Dawson et al. ..... 131/84.1

*Primary Examiner*—John G. Weiss

*Assistant Examiner*—Charles W. Anderson

*Attorney, Agent, or Firm*—Birch, Stewart, Kolasch & Birch, LLP

[57] ABSTRACT

A compression molding apparatus for a cut tobacco layer in a cigarette manufacturing machine comprises a shoe for separating the cut tobacco layer from a suction belt and feeding the cut tobacco layer onto paper and a tongue coupled integrally to the shoe. The respective lower surfaces of the shoe and the tongue are smoothly continuous with each other, and, in conjunction with a molding groove in a wrapping section, defines a compression molding passage for molding the cut tobacco layer into a rod.

9 Claims, 7 Drawing Sheets

COMPRESSION MOLDING APPARATUS FOR A CUT TOBACCO LAYER IN A CIGARETTE MANUFACTURING MACHINE

BACKGROUND OF THE INVENTION

1. Field of the Invention

The present invention relates to an apparatus for molding a cut tobacco layer into a predetermined shape by compression before a tobacco rod is formed with the cut tobacco layer and paper in a cigarette manufacturing machine.

2. Description of the Related Art

A cigarette manufacturing machine continuously forms a tobacco rod by wrapping a cut tobacco layer, attracted to a suction belt, in paper in a wrapping section.

To attain this, the cigarette manufacturing machine is provided with a compression molding apparatus for smoothly guiding the cut tobacco layer from the suction belt onto the paper in the wrapping section. An example of the compression molding apparatus of this type is disclosed in Jpn. UM Appln. KOKAI Publication No. 62-33588.

This compression molding apparatus comprises a shoe for separating the cut tobacco layer from the suction belt and a tongue located on the downstream side of the shoe with respect to the traveling direction of the paper and garniture tape. The shoe and the tongue, in conjunction with a molding groove in the wrapping section, define a compression molding passage for the cut tobacco layer. The molding groove is used to guide a garniture tape for running the paper and bends the paper along with the garniture tape into the shape of a U.

The cut tobacco layer separated from the suction belt by means of the shoe is introduced into the compression molding passage. As the cut tobacco layer passes through this passage, the cut tobacco layer is subjected to compression molding and drawn into a rod with use of the garniture tape and the paper, between the tongue and the molding groove. Thereafter, the rod-shaped cut tobacco is delivered from the tongue through its outlet, and is entirely wrapped in the paper and finally formed into a tobacco rod as it passes through upper molds in the wrapping section. If the cut tobacco layer is previously molded into a rod by compression before it reaches the upper molds in the wrapping section, it can be smoothly wrapped in the paper, so that the tobacco rod can be continuously formed with stability. The formed tobacco rod is cut into cigarettes having a given length in a cutting section, thereafter.

In order to facilitate the replacement of the garniture tape and the suction belt, the compression molding apparatus is designed so that the shoe and the tongue can be attached and detached independently of each other. When these members are attached, the upstream end of the tongue and the downstream end of the shoe are made to overlap each other so that the attachment and detachment are easy. More specifically, the downstream end of the shoe gets under the upstream end of the tongue. Thus, the top face of the compression molding passage, which is defined by the shoe and the tongue, has a difference in level between the downstream end of the shoe and the upstream end of the tongue.

This difference in level constitutes a substantial resistance to the cut tobacco layer passing through the compression molding passage. This resistance increases in proportion of the passing speed of the cut tobacco layer, that is, the speed of manufacture of tobacco rod. The passing resistance of the compression molding passage inevitably causes individual cut pieces of tobacco in the cut tobacco layer to be broken into smaller pieces. As a result, the cut tobacco cannot be wrapped in the paper with stability, and easily slips out of manufactured cigarettes through their cut ends.

SUMMARY OF THE INVENTION

The object of the present invention is to provide a compression molding apparatus for a cut tobacco layer in a cigarette manufacturing apparatus, capable of lowering the extent of breakage of cut tobacco, thereby preventing the cut tobacco from slipping out of cigarettes through their cut ends.

The above object is achieved by a compression molding apparatus for a cut tobacco layer according to the present invention, which comprises: separating means for separating a cut tobacco layer from a suction belt of a cigarette manufacturing machine and feeding the separated cut tobacco layer onto paper, the paper traveling along a paper guiding path, the separating means including a guide surface extending along the paper from the suction belt; and molding means for compressing the cut tobacco layer on the paper into a predetermined shape as the paper travels, the molding means including a compressive surface smoothly continuous with the guide surface and extending along the paper.

According to the compression molding apparatus described above, the cut tobacco layer separated from the suction belt is guided by the guide surface of the separating means as the cut tobacco layer travels together with the paper. When the cut tobacco layer on the paper advances from the guide surface to the compressive surface, thereafter, the cut tobacco layer is compressed and molded into a predetermined shape by the compressive surface. Since the guide surface and the compressive surface are smoothly continuous with each other, a traveling resistance of the cut tobacco layer never changes suddenly as the layer advances from the guide surface to the compressive surface. Thus, individual cut pieces of tobacco in the cut tobacco layer cannot be subjected to any great force, and the extent of their breakage can be lowered. As a result, the cut tobacco can be securely held in each cigarette or filter cigarette, as a final product, and can be prevented from slipping out of the cigarette through its cut end or ends.

The guide surface and the compressive surface define a compression molding passage for the cut tobacco layer in conjunction with the paper. In this case, the compressive surface has a cross-sectional shape varying continuously in the traveling direction of the paper. Thus, the cut tobacco layer passed along the compressive surface can be compressed gradually, so that the extent of breakage of the individual cut tobacco pieces can be further lowered.

Preferably, the guide surface includes a straight starting edge, situated at an inlet of the compression molding passage and serving to separate the cut tobacco layer from the suction belt, and a pre-compression region having a radius of curvature in view of a cross section of the compression molding passage, the radius of curvature gradually decreasing from the starting edge to the compressive surface. Thus, the cut tobacco layer separated from the suction belt can be guided at once into the compression molding passage, and thereafter, compressed gradually as the cut tobacco layer advances along the guide surface.

In this case, the compressive surface includes a semicircular terminal edge situated at an outlet of the compression molding passage, the terminal edge of the compressive surface having a radius of curvature shorter than that of the boundary between the guide surface and the compressive surface. Thus, the cut tobacco layer is compressed further and molded into a semicircle as the cut tobacco layer advances from the guide surface to the compressive surface.

On the other hand, the guide surface may have a holding region instead of the pre-compression region. In this case, after the cut tobacco layer is separated from the suction belt at the straight starting edge of the guide surface, the separated cut tobacco layer is hardly subjected to compression from the holding region but held between the holding region of the guide surface and the paper while the cut tobacco layer advances with the paper toward the compression surface in the compression molding passage.

The holding region also a radius of curvature in view of the traveling direction of the paper, which gradually decreases from the starting edge of the guide surface to the compression surface. In this case, the holding region has a constant maximum height from the paper guiding path along the traveling direction of the paper.

The compression molding apparatus may further comprise reducing means for reducing an area of contact between the compressive surface and the cut tobacco layer. More specifically, the reducing means has pits formed in the compressive surface for uniform distribution. Preferably, each pit has the shape of a waterdrop tapered toward the outlet of the compression molding passage. If the pits are thus distributed over the compressive surface, the frictional resistance of the cut tobacco layer on the compressive surface is reduced, so that the cut tobacco can be prevented from being broken or overheated.

Further, the guide surface and the compressive surface may be formed individually on separate members or an integral member. In the case where the guide surface and the compressive surface are formed on separate members, these members are preferably coupled integrally so that the guide surface and the compressive surface are smoothly continuous with each other.

Further scope of applicability of the present invention will become apparent from the detailed description given hereinafter. However, it should be understood that the detailed description and specific example, while indicating preferred embodiment of the invention, are given by way of illustration only, since various changes and modifications within the sprit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
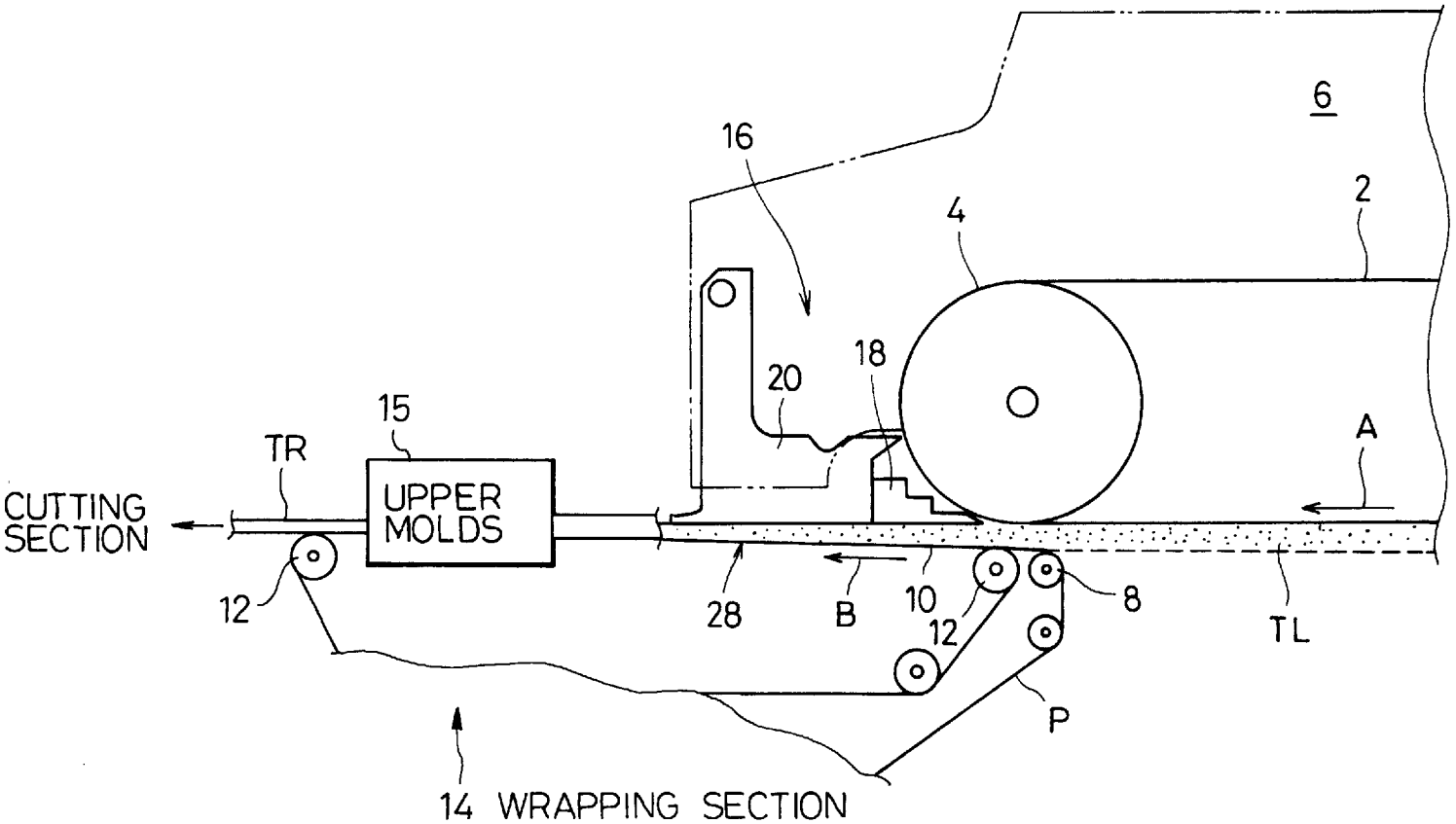
FIG. 1 is a schematic side view showing part of a cigarette manufacturing machine including a compression molding apparatus.

Referring to FIG. 1, there is shown a cigarette manufacturing machine, which comprises an endless suction belt 2. The suction belt 2 is passed around and between a pair of belt rollers 4. As the rollers 4 rotate, the belt 2 travels in the direction of arrow A in FIG. 1. Only one of the belt rollers 4 is shown in FIG. 1. The suction belt 2 is located in a suction chamber 6, which is indicated by a two-dot chain line in FIG. 1. A chimney (not shown) is provided under the belt 2, and cut tobacco is fed into the chimney. The cut tobacco in the chimney is blown up toward the suction chamber 6 under negative pressure in the chamber 6, and is attracted in a layer to the lower surface of the suction belt 2. As the belt 2 travels, a cut tobacco layer TL formed in this manner is fed in the direction of arrow A in FIG. 1.

As shown in FIG. 1, a guide roller 8 is arranged spaced right under the belt roller 4, and paper P is guided to the roller 8 from below. The paper P having passed the roller 8 is guided to a wrapping section 14. In this wrapping section 14, the paper P extends horizontally in the same direction as the feeding direction A for the cut tobacco layer TL in a manner such that it is superposed on an endless garniture tape 10.

The garniture tape 10 extends horizontally between a pair of guide rollers 12. One of the rollers 12 is located close to the guide roller 8 for the paper P. Thus, the paper P having passed the roller 8 is superposed at once on the garniture tape 10.

A horizontal portion of the garniture tape 10, along with the paper P, is guided into a molding groove 28 (FIG. 2) in the wrapping section 14. The molding groove 28 defines a paper guiding path for the paper P and garniture tape 10. Further, the tape 10 is passed around a driving drum (not shown), and travels together with the paper P in the direction of arrow B in FIG. 1 in the molding groove 28 as the driving drum rotates. In this case, the paper P travels in the same direction and at the same speed as the feeding direction A and the feeding speed for the cut tobacco layer TL.

The cut tobacco layer TL on the suction belt 2 is stripped from the belt 2 by means of a compression molding apparatus 16, and fed onto the paper P. As the tobacco layer TL travels together with the paper P, the compression molding apparatus 16, in conjunction with the molding groove 28 in the wrapping section 14, molds the layer TL into a rod by compression. As this is done, the cut tobacco layer TL is partially wrapped in the paper P from below with the aid of the garniture tape 10. The compression molding apparatus 16 will be mentioned later.

After passing through the compression molding apparatus 16, the paper P, having the cut tobacco partially wrapped therein, is bent together with the garniture tape 10 in the shape of a U. Thereafter, the paper P gets into upper molds 15 in the wrapping section 14.

The upstream-side upper mold 15 first arches one side edge portion of the U-shaped paper P along with the garniture tape 10, whereupon the cut tobacco is further wrapped in the paper P from above by one side edge portion of the paper. At the same time, paste is applied to the other side edge of the U-shaped paper P. Thereafter, the downstream-side upper mold 15 also arches the other side edge portion of the paper P, and the opposite side edges of the paper P are lapped on and bonded to each other. As a result, a tobacco rod TR, formed by entirely wrapping the cut tobacco in the paper P, is delivered continuously from the upper molds 15.

Thereafter, the lap portion of paper P of the tobacco rod TR is dried, and the rod TR is delivered to a cutting section. In the cutting section, the tobacco rod TR is cut into cigarettes having a given length.

The compression molding apparatus 16 will now be described in detail.

Figure 2:
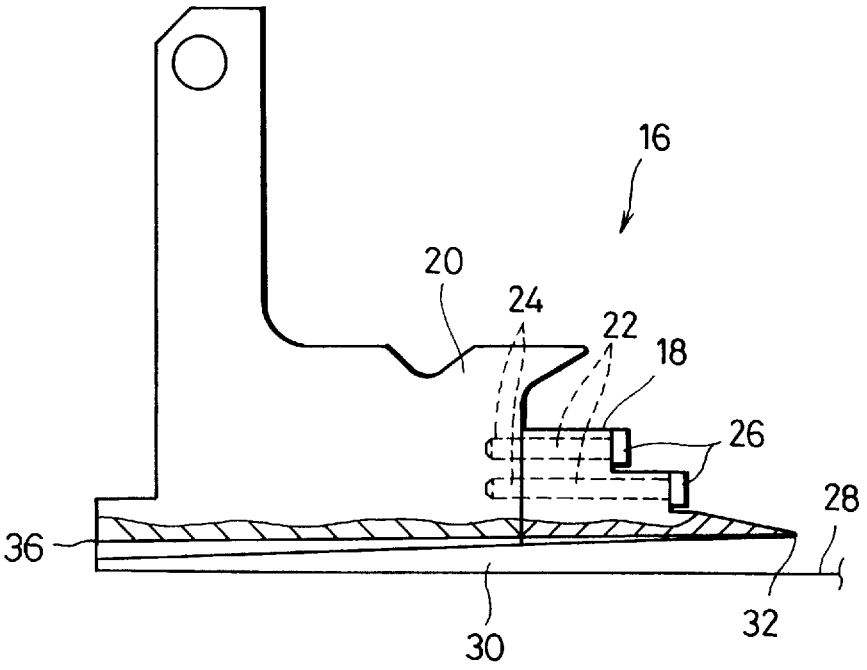
FIG. 2 is a cutaway side view of the compression molding apparatus.

The compression molding apparatus 16 is removably mounted on a frame of the cigarette manufacturing machine over the wrapping section 14. The apparatus 16 comprises a shoe 18 on the side of the belt roller 4 and a tongue 20 on the downstream side of the shoe 18. The shoe 18 and the tongue 20 are coupled integrally to each other. More specifically, as shown in FIG. 2, the shoe 18 is formed with a pair of through holes 22, upper and lower, while the tongue 20 has tapped holes 24 corresponding to the holes 22, individually. Thus, the shoe 18 and the tongue 20 are connected integrally to each other by screwing connecting bolts 26 into the tapped holes 24 of the tongue 20 through the through holes 22 of the shoe 18, individually.

The front end of the shoe 18 is wedge-shaped, and can come into contact with the outer peripheral surface of the belt roller 4 through the suction belt 2, thereby serving as a scraper for the cut tobacco layer TL. Thus, the shoe 18 can separate the cut tobacco layer TL from the suction belt 2.

Figure 3:
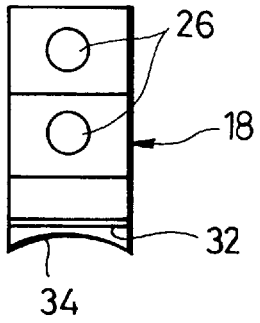
FIG. 3 is a front view showing a shoe of the compression molding apparatus.
Figure 4:
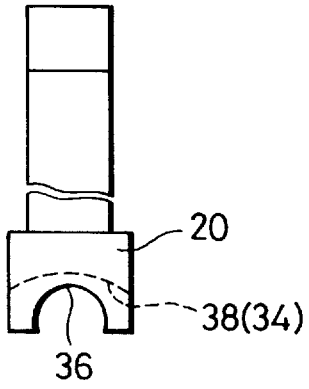
FIG. 4 is a rear view of the compression molding apparatus.

The respective lower surfaces of the shoe 18 and the tongue 20, in conjunction with the molding groove 28 in the wrapping section 14, define a compression molding passage 30. The upper edge of an inlet of the passage 30 is defined by a front edge 32 of the shoe 18, which has the form of a straight line across the passage 30. Accordingly, the front edge of the shoe 18 can be in linear contact with the suction belt 2. The lower surface of the shoe 18 has a rear edge 34 in the form of a downward circular arc. The respective shapes of the front and rear edges of the shoe 18 are clearly shown in FIG. 3.

On the other hand, the upper edge of an outlet of the compression molding passage 30 is defined by a rear edge 36 of the lower surface of the tongue 20, which has the form of a downward semicircle. Accordingly, the circular arc of the rear edge 36 of the tongue 20 has a radius of curvature smaller than that of the circular arc of the rear edge 34 of the shoe 18. Also, a front edge 38 of the lower surface of the tongue 20 also has the form of a downward circular arc. The circular arc of the front edge 38 has the same radius of curvature as that of the rear edge 34 of the shoe 18. Thus, the rear edge 34 of the shoe 18 and the front edge 38 of the tongue 20 are accurately aligned and smoothly continuous with each other in the axial direction of the molding groove 28. The respective circular shapes of the front and rear edges 38 and 36 of the tongue 20 are clearly shown in FIG. 3.

Figure 5:
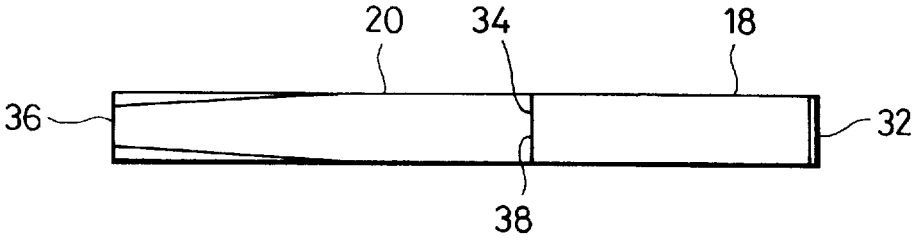
FIG. 5 is a bottom view of the compression molding apparatus.

The respective lower surfaces of the shoe 18 and the tongue 20 have a radius of curvature that decreases continuously and smoothly from the straight edge at the inlet of the compression molding passage 30 toward the semicircular edge at the outlet. As shown in FIG. 5, therefore, the lower surfaces of the shoe 18 and the tongue 20 form a downward groove that emerges gradually from the inlet of the compression molding passage 30 toward the outlet.

Further, the lower surfaces of the shoe 18 and the tongue 20 or the downward groove declines toward the outlet of the compression molding passage 30 with respect to the molding groove 28, so that the cross-sectional area of the passage 30 is reduced gradually from the inlet of the passage 30 toward the outlet.

The lower surfaces of the shoe 18 and the tongue 20 can be shaped by wire electrical discharge machining.

Figure 6:
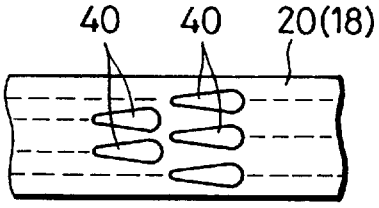
FIG. 6 is a view showing the lower surface of part of the compression molding apparatus in detail.

A large number of pits 40 (not shown in FIG. 5, see FIG. 6) are distributed uniformly over the lower surface of the tongue 20 at the least, and preferably throughout the lower surfaces of the shoe 18 and the tongue 20. Each pit 40 has the shape of a waterdrop that is tapered toward the outlet of the compression molding passage 30. Each pit 40 has the greatest depth in its central portion, and gradually becomes shallower toward its peripheral edge so that it is smoothly continuous with the lower surfaces of the shoe 18 and the tongue 20.

Referring additionally to FIGS. 7 to 10, the operation of the aforementioned compression molding apparatus 16 will be described.

Figure 7:
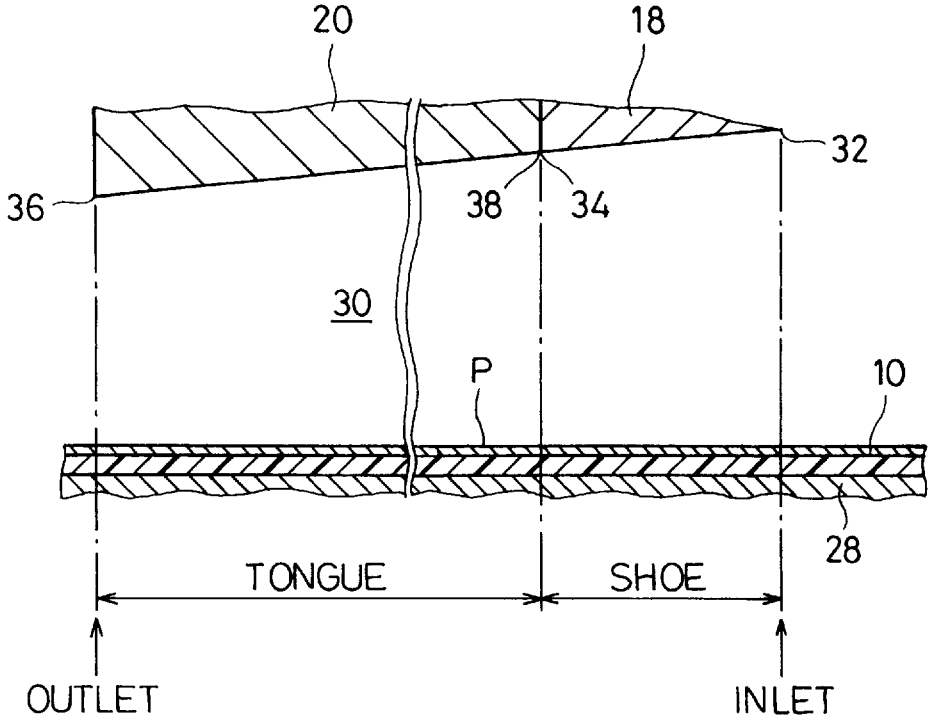
FIG. 7 is an enlarged view showing a compression molding passage of the compression molding apparatus.
Figure 8:
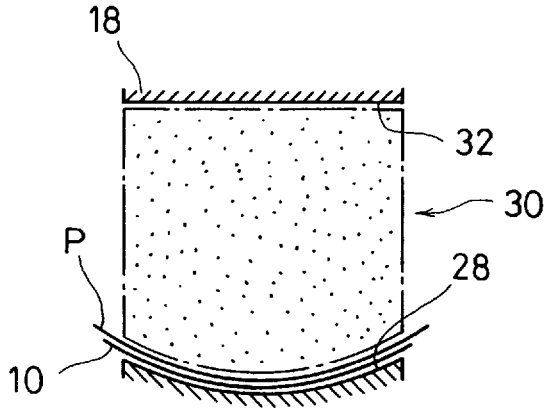
FIG. 8 is a view showing the shape of an inlet of the compression molding passage.

The cut tobacco layer TL attracted to the suction belt 2 can be separated satisfactorily from the belt 2 by means of the front edge 32 of the shoe 18 or the scraper shown in FIG. 7. The separated tobacco layer TL is guided into the compression molding passage 30 through the inlet thereof, and dropped onto the paper P. As seen from FIG. 8, the molding groove 28 in the wrapping section 14 is slightly arcuated at the inlet of the passage 30. Accordingly, the paper P is also slightly curved together with the garniture tape 10. In FIG. 8, the dashed line represents the shape of the inlet of the compression molding passage 30.

Figure 9:
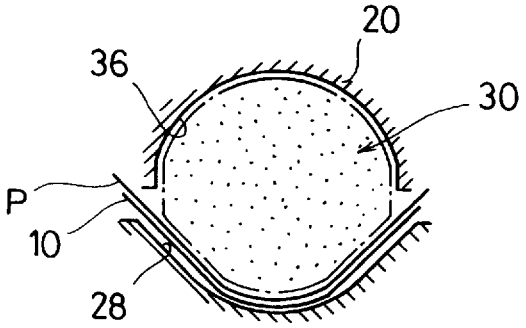
FIG. 9 is a view showing the shape of an outlet of the compression molding passage.

As the garniture tape 10 or the paper P travels, the cut tobacco layer TL in the compression molding passage 30, along with the paper P, is moved toward the outlet of the compression molding passage 30. As mentioned before, the cross section of the top wall of the passage 30 varies smoothly and continuously in shape from the straight edge at the inlet toward the semicircular edge at the outlet. On the other hand, the cross section of the molding groove 28 has the shape of a circular arc whose radius of curvature decreases gradually from the inlet of the passage 30 toward the outlet. Thus, the cut tobacco layer TL moving in the passage 30 is gradually subjected to compressive action to be drawn into a rod. As seen from FIG. 9, the paper P is also bent together with the garniture tape 10 to be U-shaped along the molding groove 28. As a result, a rod of cut tobacco is delivered from the outlet of the compression molding passage 30. In FIG. 9, the dashed line represents the shape of the outlet of the passage 30.

Thereafter, the paper P and the cut tobacco having passed the compression molding apparatus 16 are continuously molded into the tobacco rod TR in the aforesaid manner, and cut into individual cigarettes.

Since the respective lower surfaces of the shoe 18 and the tongue 20 have a shape that varies smoothly and continuously from the inlet of the compression molding apparatus to the outlet, the flow resistance of the compression molding passage 30 makes no substantial change in the middle of the passage 30. When the cut tobacco layer TL passes through the passage 30, therefore, the individual cut tobacco pieces cannot be subjected to any great force, so that the extent of their breakage can be lowered.

Since the aforesaid numerous pits 40 are formed in the lower surfaces of the shoe 18 and the tongue 20, moreover, the area of contact of the compression molding passage 30 with the cut tobacco layer TL is reduced considerably. This is also very helpful to the reduction of the extent of breakage of the cut tobacco pieces.

Thus, the cut tobacco pieces in the formed tobacco rod TR can be securely held in the rod TR, thereafter. In consequence, the possibility of the cut tobacco pieces slipping out of each cigarette through its cut end or ends can be lowered when the tobacco rod TR is cut into the cigarettes or when each cigarette is further cut into half cigarettes for forming filter cigarettes.

Figure 10:
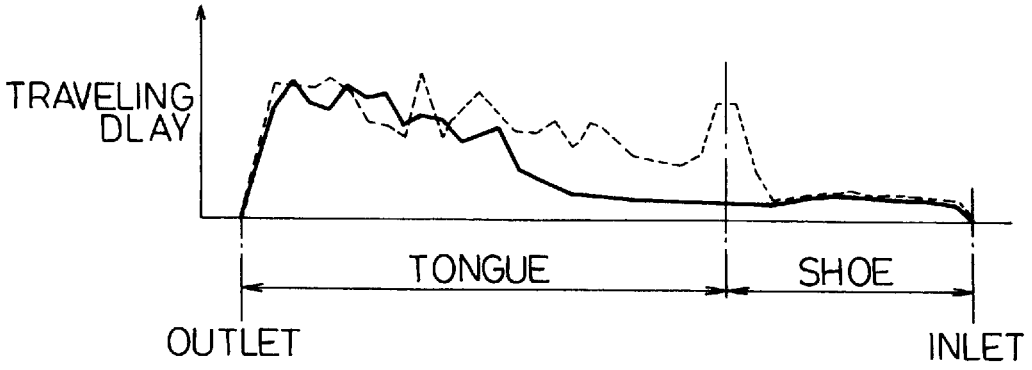
FIG. 10 is a graph showing a delay of travel of a cut tobacco layer behind the travel of paper.

In FIG. 10, the full line indicates a delay of travel of the cut tobacco layer TL behind the travel of the paper P in the compression molding passage 30. In FIG. 10, moreover, the broken line indicates a delay of travel of the cut tobacco layer TL in the conventional compression molding passage. In the case of the compression molding passage 30, as seen from FIG. 10, the traveling delay of the cut tobacco layer TL makes no sudden change at the boundary between the shoe 18 and the tongue 20. In the conventional case, on the other hand, the traveling delay of the cut tobacco layer TL suddenly increases at the boundary. This also indicates that the compression molding passage 30 according to the present embodiment can lower the extent of breakage of the cut tobacco pieces.

Figure 11:
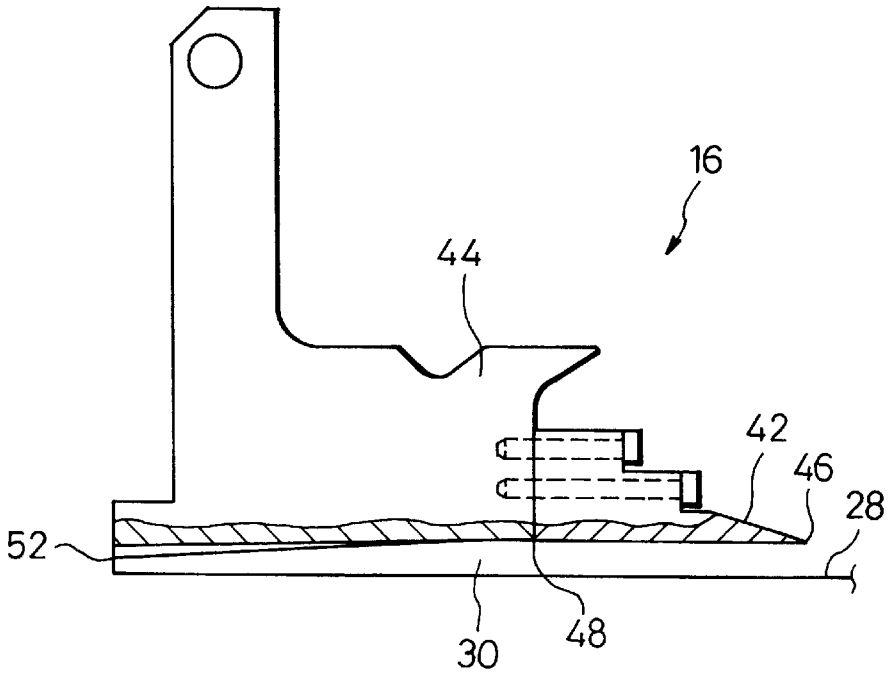
FIG. 11 is a cutaway view of a modification of the compression molding apparatus.
Figure 12:
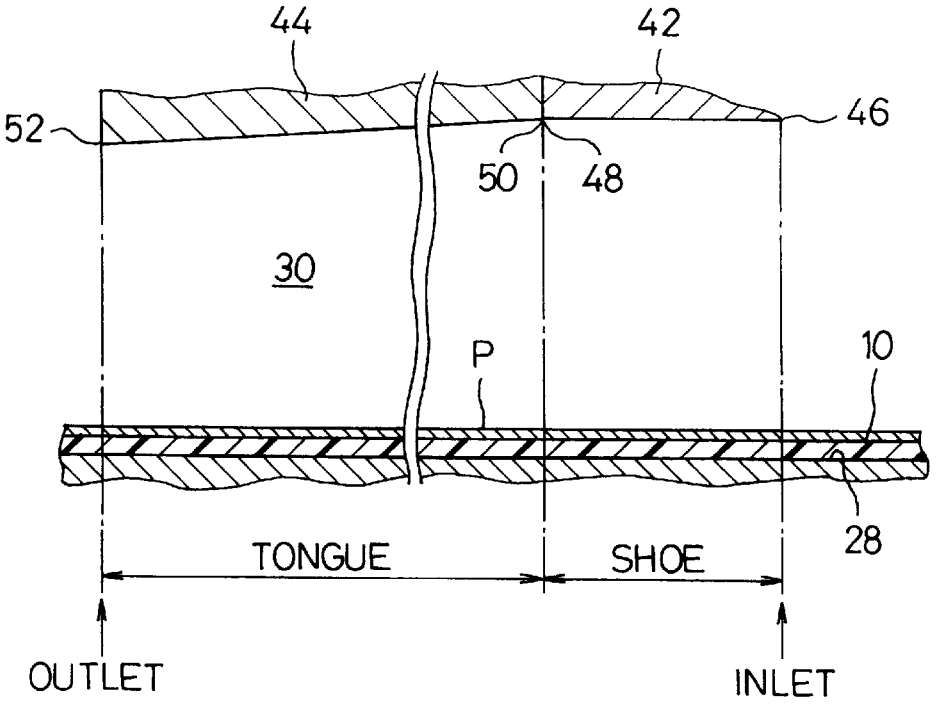
FIG. 12 is an enlarged view showing the compression molding apparatus of FIG. 11.

Referring now to FIGS. 11 and 12, there is shown a modification of the compression molding apparatus. In this case, the apparatus comprises a shoe 42 and a tongue 44 that are coupled integrally to each other. The lower surface of the shoe 42 is formed as a holding surface ranging from its front edge 46 to Its rear edge 48. The lower surface of the shoe 42 has a similar shape to that of the lower surface of the shoe 18. The lower surface of the shoe 42 has therefore a front edge 46 in the shape of a straight line and a rear edge 48 in the shape of a circular arc. The cross section of the lower surface of the shoe 42 varies smoothly and continuously in shape from the straight portion at its front edge 46 toward a circular arc at the rear edge 48. However, the lower surface of the shoe 42 has a constant maximum height from the molding groove 28 along the molding groove 28. In the other words, the shoe 42 forms a downward groove which has a horizontal bottom line.

On the other hand, the lower surface of the tongue 44 is smoothly connected with the lower surface of the shoe 42. The cross section of the lower surface of the tongue 44 varies smoothly and continuously in shape from a straight portion at its front edge 50 toward a semicircular portion at its rear edge 52. Thus, the tongue 44 also forms a downward groove which declines toward the outlet of the compression molding passage 30.

Since the lower surface of the shoe 42 is horizontal, according to this modification, the shoe 42 is used to separate the cut tobacco layer TL from the suction belt 2 and guide the separated layer TL into the compression molding passage 30. In this case, the shoe 42 never substantially compresses the cut tobacco layer TL but holds the cut tobacco layer TL while the cut tobacco layer TL advances toward the tongue 44 with the paper P.

After having passed the shoe 42, however, the cut tobacco layer TL is subjected to compression molding between the lower surface of the tongue 44 and the molding groove 28. More specifically, the tobacco layer TL is not compressed immediately after it enters the compression molding passage 30, but starts to undergo compression molding when the cut tobacco layer TL passes through the tongue 44.

Also in the case of the compression molding apparatus according to the modification described above, the shape of the top face of the compression molding passage 30 makes no sudden change at the boundary between the shoe 42 and the tongue 44. Thus, the shoe 42 and the tongue 44 have the same advantages as their counterparts in the foregoing compression molding apparatus 16.

Figure 13:
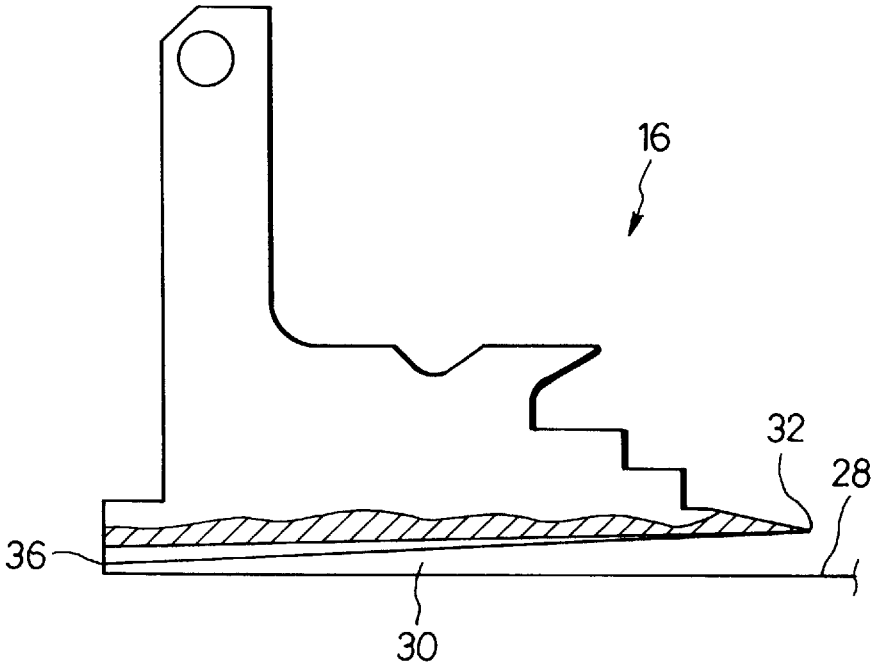
FIG. 13 is a view showing another modification of the compression molding apparatus.

Although the shoe and the tongue are constructed as separate members according to the embodiment and modification described above, they or the compression molding apparatus may alternatively be formed as an integral structure, as shown in FIG. 13.

The pits formed in the lower surfaces of the shoe and the tongue are not limited to the illustrated shape, and may be in various other shapes as long as they can reduce the area of contact with the cut tobacco layer TL.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A compression molding apparatus for a cut tobacco layer in a cigarette manufacturing machine, which includes a suction belt for forming the cut tobacco layer and a wrapping section for running paper in a paper guiding path and continuously forming a tobacco rod, said compression molding apparatus comprising:

separating means for separating the cut tobacco layer from the suction belt and feeding the separated cut tobacco layer onto the paper, said separating means including a guide surface extending along the paper guiding path from the suction belt, said guide surface including a straight starting edge, situated at an inlet of said compression molding passage and serving to separate the cut tobacco layer from the suction belt, and a pre-compression region having a radius of curvature in a cross-sectional direction of the compression molding passage, the radius of curvature gradually decreasing from the starting edge to said compressive surface; and molding means for compressing the cut tobacco layer on the paper into a predetermined shape as the paper travels, said molding means including a compressive surface smoothly continuous with said guide surface and extending along the paper.

2. The apparatus according to claim 1, wherein said guide surface and said compressive surface define a compression molding passage for the cut tobacco layer in conjunction with the paper, and said compressive surface has a cross-sectional shape varying continuously in the traveling direction of the paper.

3. The apparatus according to claim 1, wherein said compressive surface includes a semicircular terminal end situated at an outlet of said compression molding passage, the terminal edge of said compressive surface having a radius of curvature shorter than that of the boundary between said guide surface and said compressive surface.

4. The apparatus according to claim 4, wherein said compressive surface includes a semicircular terminal edge, situated at an outlet of said compression molding passage, and a compression region having a radius of curvature in view of a cross section of said compression molding passage, the radius of curvature gradually increasing from the terminal edge to said guide surface.

5. The apparatus according to claim 1, further comprising reducing means for reducing an area of contact between said compressive surface and the cut tobacco layer.

6. The apparatus according to claim 5, wherein said reducing means has pits formed in the compressive surface for uniform distribution.

7. The apparatus according to claim 6, wherein each of said pit has the shape of a waterdrop tapered toward an outlet of said compression molding passage.

8. The apparatus according to claim 1, wherein said guide surface and said compressive surface are formed on an integral member.

9. The apparatus according to claim 1, wherein said guide surface has a constant maximum height from said starting edge to said compressive surface.

* * * * *